US010132155B2

(12) United States Patent
Coble et al.

(10) Patent No.: US 10,132,155 B2
(45) Date of Patent: Nov. 20, 2018

(54) INSTRUMENTED SUBSEA FLOWLINE JUMPER CONNECTOR

(71) Applicant: OneSubsea IP UK Limited, London (GB)

(72) Inventors: Jack Coble, Houston, TX (US); Alireza Shirani, Houston, TX (US); Marcus Lara, Cypress, TX (US); Akshay Kalia, Houston, TX (US); Jan Illakowicz, Spring, TX (US)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 15/368,356

(22) Filed: Dec. 2, 2016

(65) Prior Publication Data

US 2018/0156024 A1 Jun. 7, 2018

(51) Int. Cl.

| | |
|---|---|
| ***E21B 47/00*** | (2012.01) |
| ***E21B 33/038*** | (2006.01) |
| ***E21B 43/01*** | (2006.01) |
| ***E21B 43/013*** | (2006.01) |
| ***E21B 43/017*** | (2006.01) |
| ***E21B 19/00*** | (2006.01) |
| ***E21B 47/10*** | (2012.01) |
| ***E21B 47/12*** | (2012.01) |

(52) U.S. Cl.

CPC ..... *E21B 47/0001* (2013.01); *E21B 19/002* (2013.01); *E21B 33/038* (2013.01); *E21B 43/013* (2013.01); *E21B 43/017* (2013.01); *E21B 43/0107* (2013.01); *E21B 47/1025* (2013.01); *E21B 47/12* (2013.01)

(58) Field of Classification Search

CPC .. E21B 47/0001; E21B 47/1025; E21B 47/12; E21B 19/002; E21B 33/038; E21B 43/013; E21B 43/017

See application file for complete search history.

(56) References Cited

U.S. PATENT DOCUMENTS

| | | | | |
|---|---|---|---|---|
| 3,373,807 A * | 3/1968 | Fischer | ..... | E21B 43/013 166/342 |
| 3,523,579 A | 8/1970 | Nelson | | |
| 4,225,160 A | 9/1980 | Ortloff | | |
| 4,290,311 A | 9/1981 | Brewer | | |
| 5,320,175 A * | 6/1994 | Ritter | ..... | E21B 43/013 166/339 |

(Continued)

FOREIGN PATENT DOCUMENTS

| | | |
|---|---|---|
| EP | 1832798 A1 | 9/2007 |
| GB | 2457278 A | 8/2009 |

(Continued)

OTHER PUBLICATIONS

Extended European Search Report issued in European Patent Appl. No. 17204152.7 dated Apr. 25, 2018; 9 pages.

(Continued)

*Primary Examiner* — Matthew R Buck
*Assistant Examiner* — Aaron L Lembo
(74) *Attorney, Agent, or Firm* — Brandon S. Clark

(57) ABSTRACT

A subsea flowline jumper connector includes at least one electronic connector deployed thereon. The sensor may provide data indicative of the connector state during installation and production operations.

16 Claims, 8 Drawing Sheets

(56) References Cited

U.S. PATENT DOCUMENTS 6,257,162 B1 * 7/2001 Watt ..... B63C 11/42 114/221 R
6,481,504 B1 * 11/2002 Gatherar ..... E21B 43/013 166/344
6,663,453 B2 * 12/2003 Quigley ..... B32B 1/08 441/133
6,700,835 B1 * 3/2004 Ward ..... F16L 1/26 367/131
7,044,228 B2 * 5/2006 Langford ..... B01D 17/0211 166/343
7,565,931 B2 * 7/2009 Saucier ..... E21B 33/035 166/344
8,555,978 B2 * 10/2013 Ganelin ..... E21B 17/01 166/344
8,857,519 B2 * 10/2014 Hale ..... E21B 43/017 166/267
8,950,497 B2 * 2/2015 Critsinelis ..... E21B 43/01 166/338
9,181,942 B2 * 11/2015 Batho ..... F04B 47/06
9,214,816 B2 * 12/2015 Batho ..... E21B 41/0007
9,534,452 B2 * 1/2017 Hatton ..... E21B 17/015
9,534,453 B2 * 1/2017 Machin ..... E21B 17/012
9,657,525 B2 * 5/2017 Ray ..... E21B 33/035
2003/0145997 A1 8/2003 Langford et al.
2003/0145998 A1 * 8/2003 Langford ..... B01D 17/0211 166/350
2006/0118308 A1 * 6/2006 Saucier ..... E21B 33/035 166/344
2010/0288503 A1 11/2010 Cuiper et al.
2011/0297389 A1 * 12/2011 McKay ..... B66D 1/36 166/349
2012/0107050 A1 * 5/2012 Wolbers ..... B63B 27/24 405/171
2012/0192982 A1 8/2012 Roberts et al.
2012/0275274 A1 * 11/2012 Gochnour ..... H04B 11/00 367/134
2012/0294114 A1 * 11/2012 Gochnour ..... E21B 43/0122 367/13
2013/0043035 A1 * 2/2013 Hale ..... E21B 43/017 166/338
2013/0292129 A1 * 11/2013 Tan ..... E21B 17/015 166/350
2016/0044390 A1 * 2/2016 Hunter ..... H04Q 9/00 340/850
2016/0273694 A1 9/2016 Cox et al.
2016/0340988 A1 11/2016 Abou-Assaad et al.
2016/0362956 A1 * 12/2016 Older ..... E21B 43/013
2018/0156026 A1 6/2018 Kalia et al.

FOREIGN PATENT DOCUMENTS

WO 2006050488 A1 5/2006
WO 2009109747 A1 9/2009
WO 2011119479 A1 9/2011

OTHER PUBLICATIONS

Extended European Search Report issued in European Patent Appl. No. 17204188.1 dated Jun. 28, 2018; 8 pages.

* cited by examiner

INSTRUMENTED SUBSEA FLOWLINE JUMPER CONNECTOR

CROSS REFERENCE TO RELATED APPLICATIONS

None.

FIELD OF THE INVENTION

Disclosed embodiments relate generally to subsea flowline jumpers and more particularly to an instrumented subsea flowline jumper connection and methods for monitoring connection integrity during flowline jumper installation and subsea production operations.

BACKGROUND INFORMATION

Flowline jumpers are used in subsea hydrocarbon production operations to provide fluid communication between two subsea structures located on the sea floor. For example, a flowline jumper may be used to connect a subsea manifold to a subsea tree deployed over an offshore well and may thus be used to transport wellbore fluids from the well to the manifold. As such a flowline jumper generally includes a length of conduit with connectors located at each end of the conduit. Clamp style and collet style connectors are commonly utilized and are configured to mate with corresponding hubs on the subsea structures. As is known in the art, these connectors may be oriented vertically or horizontally with respect to the sea floor (the disclosed embodiments are not limited in this regard).

Subsea installations are time consuming and very expensive. The flowline jumpers and the corresponding connectors must therefore be highly reliable and durable. Flowline jumper connectors can be subject to large static and dynamic loads (and vibrations) during installation and routine use (e.g., due to thermal expansion and contraction of pipeline components as well as due to flow induced vibrations and vortex induced vibrations). These loads and vibrations may damage and/or fatigue the connectors and may compromise the integrity of the fluid connection. There is a need in the art for flowline jumper technology that provides for improved connector reliability.

SUMMARY

A subsea measurement system includes a flowline jumper deployed between first and second subsea structures. The flowline jumper provides a fluid passageway between the first and second subsea structures and includes a length of conduit and first and second connectors deployed on opposing ends of the conduit. The first and second connectors are connected to corresponding hubs on the first and second subsea structures. At least one electronic sensor is deployed on at least one of the first and second connectors. Clamp style and collet style connector embodiments are also disclosed.

A method is disclosed for installing a flowline jumper between first and second subsea structures. The flowline jumper includes first and second connectors deployed on opposing ends thereof. Information including specifications for the first connector is read (or received) from a transmitter deployed on the first connector. A connection is made between the first connector and the first subsea structure. Sensor data is received from the transmitter which is in electronic communication with at least one sensor deployed on the first connector. The sensor data is processed to verify that the connection meets the received specifications.

The disclosed embodiments may provide various technical advantages. For example, certain of the disclosed embodiments may provide for more reliable and less time consuming jumper installation. For example, available sensor data from the connector may improve first pass installation success. The disclosed embodiments may further enable the state of the connection system to be monitored during jumper installation and production operations via providing sensor data to the surface. Such data may provide greater understanding of the system response and performance and may also decrease or even obviate the need for post installation testing of the jumper connectors.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which.

DETAILED DESCRIPTION

Figure 1:
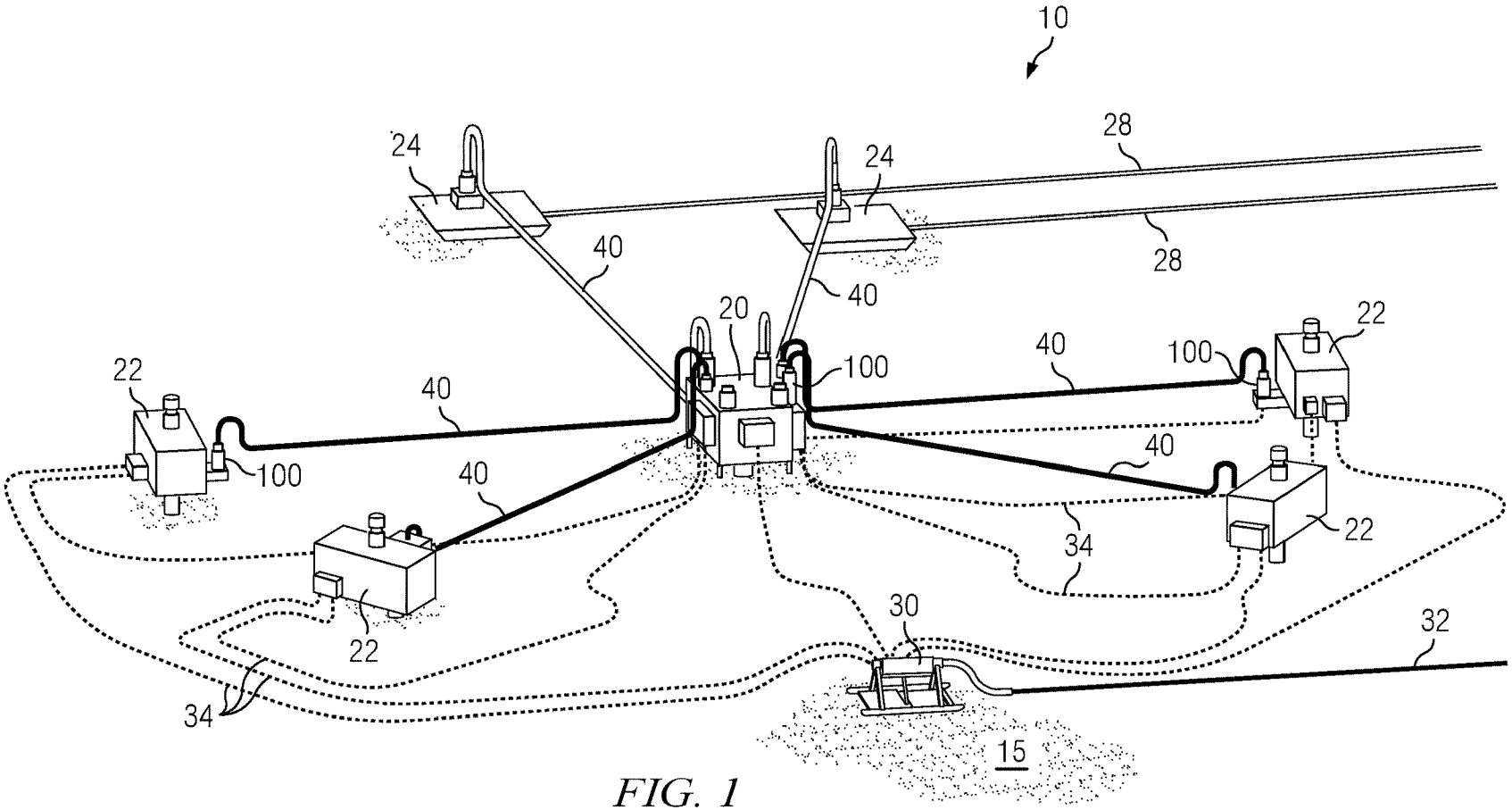
FIG. 1 depicts an example subsea production system in which disclosed flowline jumper embodiments may be utilized.
Figure 2:
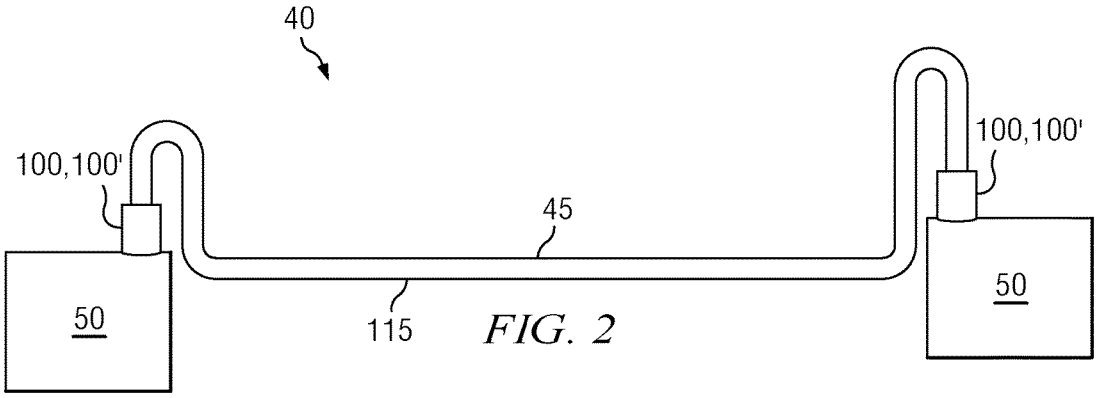
FIG. 2 depicts one example flowline jumper embodiment.

FIG. 1 depicts an example subsea production system 10 (commonly referred to in the industry as a drill center) suitable for using various method and connector embodiments disclosed herein. The system 10 may include a subsea manifold 20 deployed on the sea floor 15 in proximity to one or more subsea trees 22 (also referred to in the art as Christmas trees). As is known to those of ordinary skill each of the trees 22 is generally deployed above a corresponding subterranean well (not shown). In the depicted embodiment, fluid communication is provided between each of the trees 22 and the manifold 20 via a flowline jumper 40 (commonly referred to in the industry as a well jumper). The manifold 20 may also be in fluid communication with other subsea structures such as one or more pipe line end terminals (PLETs) 24. Each of the PLETs is intended to provide fluid communication with a corresponding pipeline 28. Fluid communication is provided between the PLETs 24 and the manifold 20 via corresponding flowline jumpers 40 (sometimes referred to in the industry as spools). As described in more detail below the flowline jumpers 40 are connected to the various subsea structures 20, 22, and 24 via jumper connectors 100, 100' (FIG. 2).

FIG. 1 further depicts a subsea umbilical termination unit (SUTU) 30. The SUTU 30 may be in electrical and/or electronic communication with the surface via an umbilical line 32. Control lines 34 provide electrical and/or hydraulic communication between the various subsea structures 20 and 22 deployed on the sea floor 15 and the SUTU 30 (and therefore with the surface via the umbilical line 32). These control lines 34 are also sometimes referred to in the industry as "jumpers". Despite the sometimes overlapping terminology, those of skill in the art will readily appreciate that the flowline jumpers 40 (referred to in the industry as spools, flowline jumpers, and well jumpers) and the control lines 34 (sometimes referred to in the industry as jumpers) are distinct structures having distinct functions (as described above). The disclosed embodiments are related to flowline jumper connectors 100 as described in more detail below.

It will be appreciated that the disclosed embodiments are not limited merely to the subsea production system configuration depicted on FIG. 1. As is known to those of ordinary skill in the art, numerous subsea configurations are known in the industry, with individual fields commonly employing custom configurations having substantially any number of interconnected subsea structures. Notwithstanding, fluid communication is commonly provided between various subsea structures (either directly or indirectly via a manifold) using flowline jumpers 40 and corresponding jumper connectors 100. The disclosed flowline jumper connector embodiments may be employed in substantially any suitable subsea operation in which flowline jumpers are deployed.

As described in more detail below with respect to FIGS. 3-4, at least one of the jumper connectors 100 shown on FIG. 1 includes one or more load, proximity, and/or leak detection sensors deployed thereon. The sensors may be in hardwired or wireless communication with the subsea structures to which the jumpers connectors 100 are connected (e.g., with the manifold 20 or the tree 22, in FIG. 1) as well as with the SUTU 30 and the surface via control lines 34 and umbilical line 32.

FIG. 2 schematically depicts one example flowline jumper embodiment 40 deployed between first and second subsea structures 50 and 50' (e.g., between a tree and a manifold or between a PLET and a manifold as described above with respect to FIG. 1). In the depicted embodiment, the jumper includes a conduit 45 (e.g., a rigid or flexible conduit such as a length of cylindrical pipe) deployed between first and second jumper connectors 100, 100'. Flowline jumper connectors 100, 100' are commonly configured for vertical tie-in and may include substantially any suitable connector configuration, for example, clamp style or collet style connectors (e.g., as depicted on FIGS. 3 and 4) configured to mate with corresponding hubs on the subsea equipment. While the connectors are commonly oriented vertically downward (e.g., as depicted) to facilitate jumper installation with vertically oriented hubs, it will be understood that the disclosed embodiments are not limited in this regard. Horizontal tie in techniques are also known in the art and are common in larger bore connections.

Figure 3A:
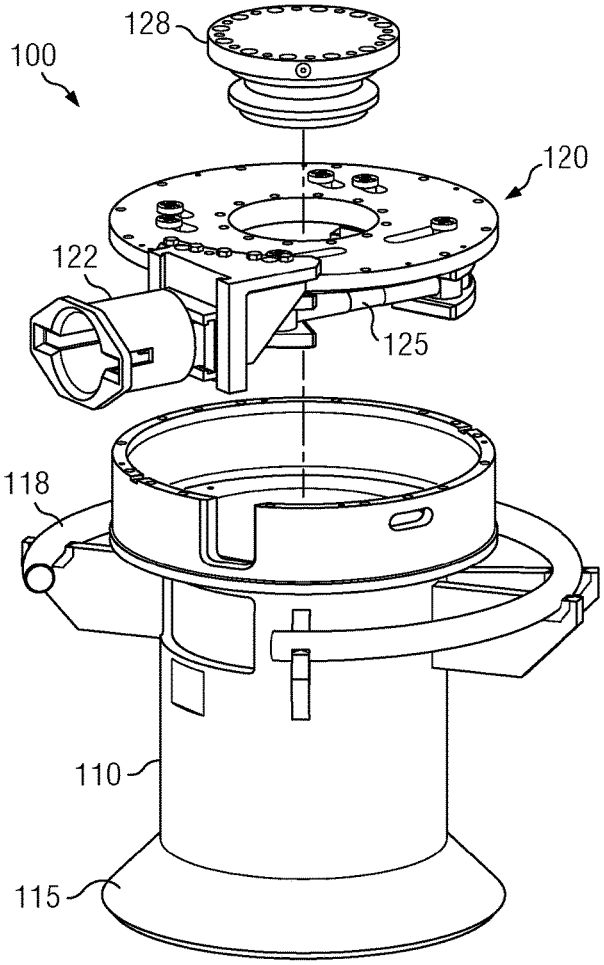
FIGS. 3A, 3B, and 3C (collectively FIG. 3) depict one example of an instrumented clamp style flowline connector.
Figure 3B:
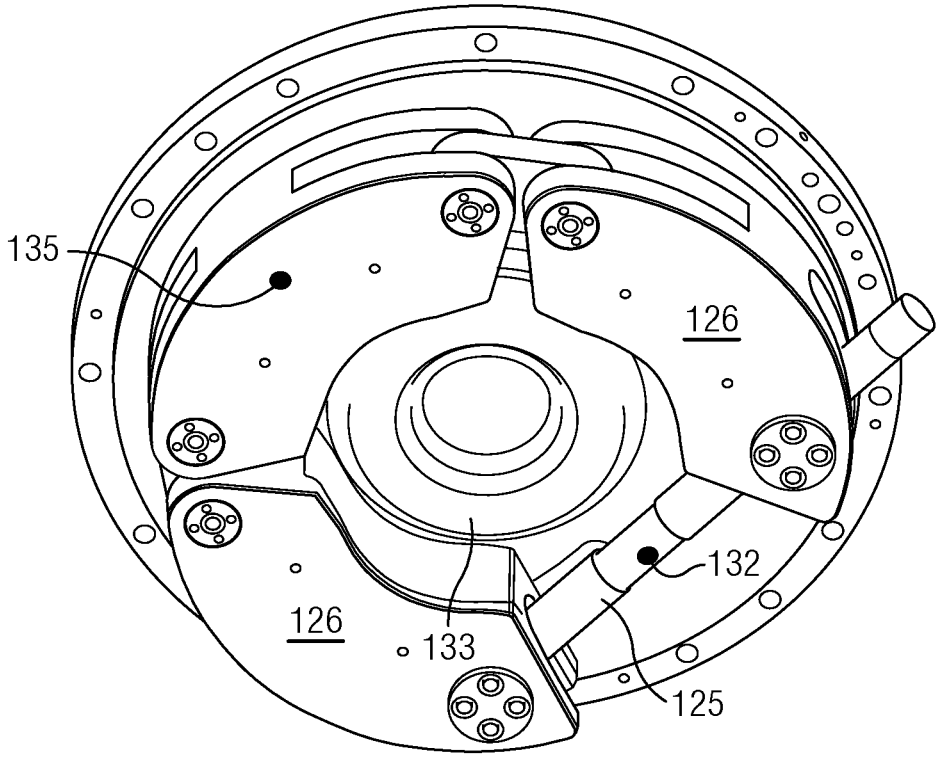
Figure 3C:
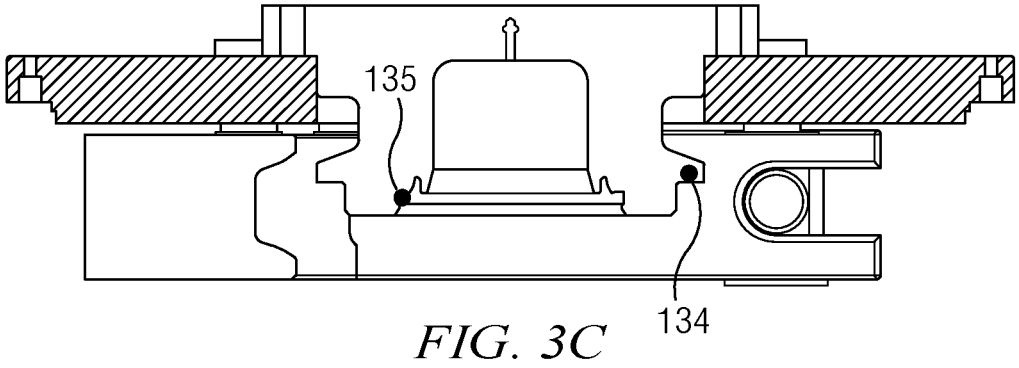

FIGS. 3 and 4 depict example instrumented connectors 100 and 100'. FIG. 3A depicts a partially exploded view of one example clamp style connector 100. FIGS. 3B and 3C depict perspective and side views of a clamp segment 120 portion of the connector 100. As depicted on FIG. 3A, example connector embodiment 100 may include a housing 110 having a deployment funnel 115 (sometimes referred to in the art as a capture zone) sized and shaped for deployment about a hub (not shown) on a subsea structure. An optional grab bar 118 (or other similar device) may be provided such that a remotely operated vehicle (ROV), an autonomous underwater vehicle (AUV), or substantially any other suitable mobile vehicle (not shown in FIG. 2) may engage the connector 100 (e.g., to provide ROV or AUV stabilization and tool reaction points during subsea operations). The clamp segment 120 (also depicted on FIGS. 3B and 3C) is deployed in the connector body 110 (on an axially opposed end from the funnel 115). An ROV intervention bucket 122 engages a lead screw 125 that further engages the clamping mechanism 126 such that rotation of the lead screw 125 selectively opens and closes the clamping mechanism 126 (as depicted on FIG. 3B). The connector may further include an outboard connector hub 128 deployed in the clamp segment 120.

As further depicted on FIGS. 3A, 3B, and 3C, connector 100 includes at least one sensor such as a load sensor or a leak sensor, deployed thereon. For example, in the depicted embodiment, the connector 100 may include a load sensor 132 deployed on the lead screw 125. The load sensor 132 may include one or more strain gauges deployed, for example, on an external surface of the lead screw 125 and configured to measure the load (or strain) in the lead screw 125 upon closing the clamp mechanism 120 against the hub (and in this way may be used to infer the clamping force or preload of the connector). One or more strain gauges may be deployed, for example, such that the strain gauge axis is parallel with the axis of the lead screw 125 (such that the strain gauge is sensitive to axial loads in the screw) and/or perpendicular with the axis of the lead screw 125 (such that the strain gauge is sensitive to cross axial loads in the screw). The disclosed embodiments are not limited in this regard.

With continued reference to FIGS. 3A, 3B, and 3C, connector 100 may additionally and/or alternatively include a load sensor 134 and/or a proximity sensor 133 deployed on a face of the outboard connector hub 128. A load sensor 134 may include a load cell (e.g., including a piezoelectric transducer) or one or more strain gauges, for example, as described above with respect to sensor 132. A load sensor 134 may be configured to measure the compressive force generated between the outboard connector hub 128 and the subsea structure hub (not shown) about which the funnel 115 is deployed during installation. A proximity sensor 133 may include substantially any suitable proximity sensor (e.g., an electromagnetic sensor, a capacitive sensor, a photoelectric sensor, or a mechanical switch) and may be configured to monitor the approach of the subsea structure hub towards the outboard connector hub 128 during connector installation.

With still further reference to FIGS. 3A, 3B, and 3C, connector 100 may additionally and/or alternatively include a leak detection sensor 135 deployed on the clamp mechanism 126 (or elsewhere on the clamp segment 120) or the outboard connector hub 128. A leak detection sensor 135 may include an electrochemical sensor, a catalytic sensor, or an electromagnetic interference sensor capable of sensing the presence of hydrocarbons in the surrounding seawater.

Figure 4A:
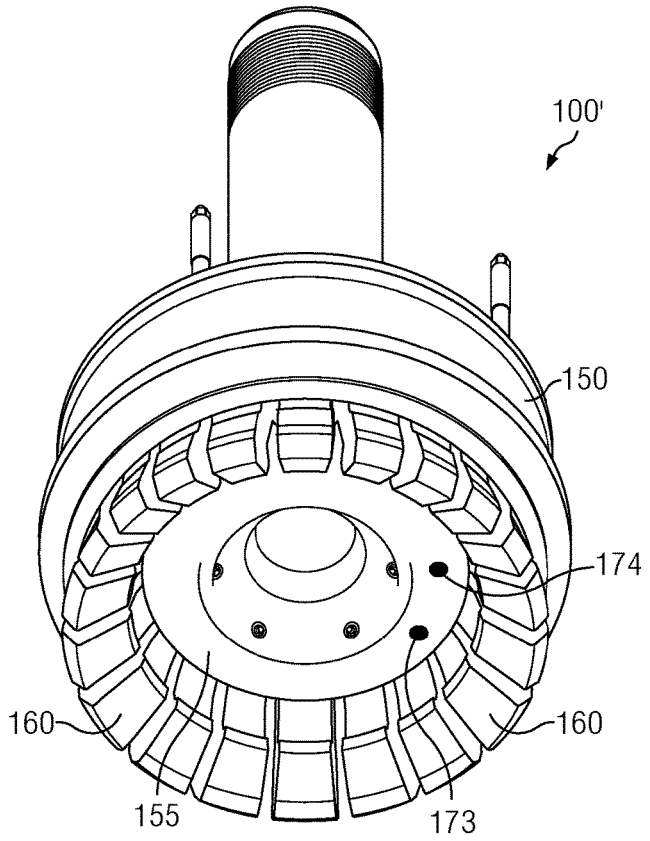
FIGS. 4A and 4B (collectively FIG. 4) depict one example of an instrumented collet style flowline connector.
Figure 4B:
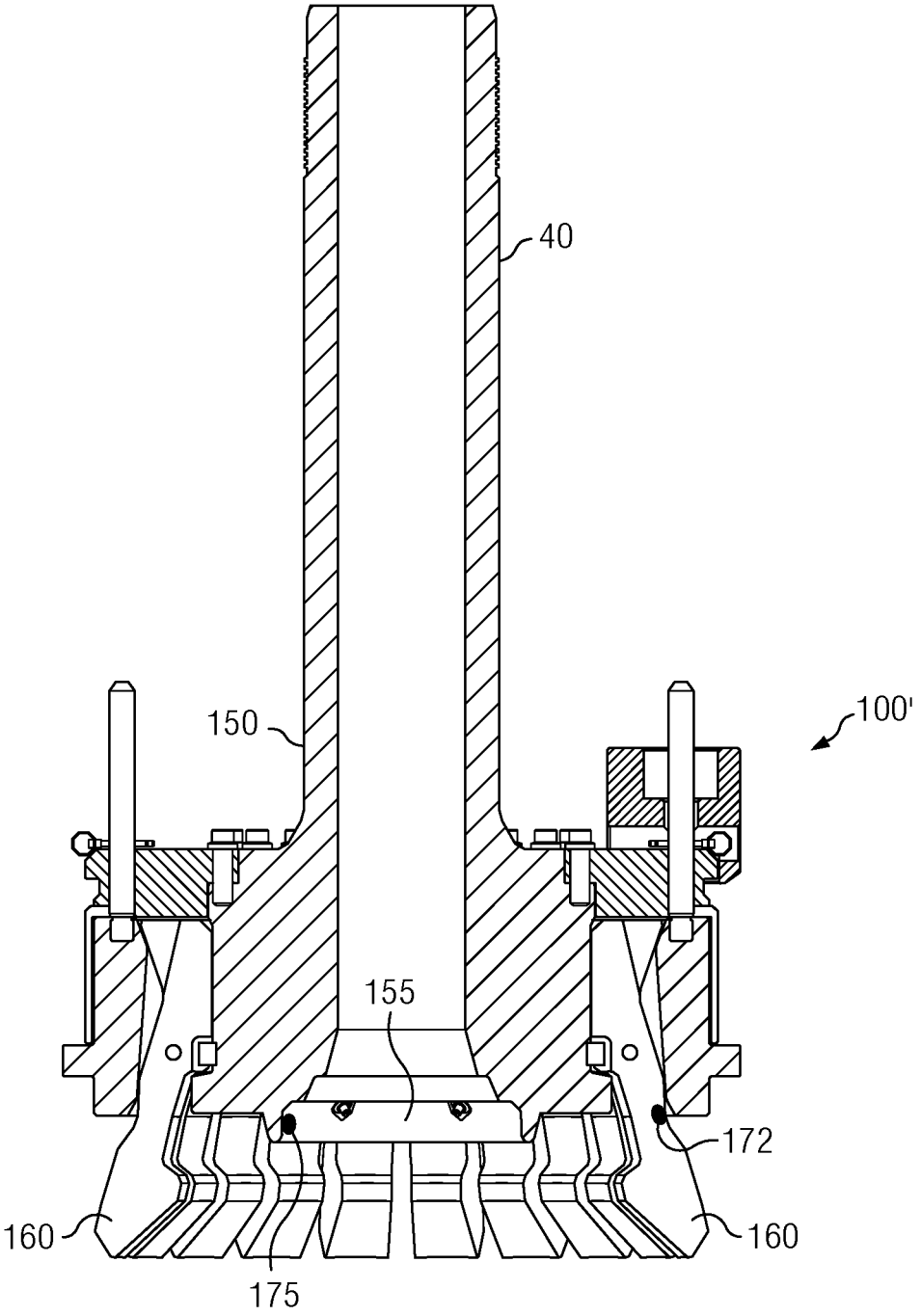

FIGS. 4A and 4B depict perspective and side views of one example collet style connector 100'. Example connector embodiment 100' may include a connector body 150 welded to a flowline jumper 40. A plurality of circumferentially spaced collet segments 160 are coupled to the connector body 150 and are configured for deployment about and engagement with a corresponding ring or flange on a subsea structure hub (not shown). An outboard connector hub 155 is deployed on a lower end of the connector body 150 and internal to the collet segments 160.

As further depicted on FIGS. 4A and 4B, connector 100' includes at least one sensor such as a load sensor or a leak sensor, deployed thereon. For example, in the depicted embodiment, the connector 100' may include a load sensor 172 deployed on one or more of the collet segments 160. The load sensor 172 may include one or more strain gauges deployed, for example, on an external surface of the collet segments 160 and configured to measure the load (or strain) in the collet segment upon engaging the subsea structure hub (and in this way may be used to infer the engagement force or preload of the connector). One or more strain gauges may be deployed, for example, such that the strain gauge axis is parallel with an axis or length of the collet segment (such that the strain gauge is sensitive to axial loads in the collet segment) and/or perpendicular with an axis or length of the collet segment (such that the strain gauge is sensitive to cross axial loads in the collet segment). The disclosed embodiments are not limited in this regard.

With continued reference to FIGS. 4A and 4B, connector 100' may additionally and/or alternatively include a load sensor 173 and/or a proximity sensor 174 deployed on a face of the outboard connector hub 155. A load sensor 173 may include a load cell or one or more strain gauges, for example, as described above with respect to sensor 172. A load sensor 173 may be configured to measure the compressive force generated between the outboard connector hub 155 and the subsea structure hub (not shown) during engagement with the collet segments 160. A proximity sensor 174 may include substantially any suitable proximity sensor as described above with respect to connector 100' and may be configured to monitor the approach of the outboard connector hub 155 towards the subsea structure hub during engagement of the collet segments 160. A proximity sensor 174 may also provide information about hub separation during a production operation.

With still further reference to FIGS. 4A and 4B, connector 100' may additionally and/or alternatively include a leak detection sensor 175 deployed on a lower end of the connector body 150 or the outboard connector hub 155. As described above, a leak detection sensor 175 may include an electrochemical sensor, a catalytic sensor, or an electromagnetic interference sensor capable of sensing the presence of hydrocarbons in seawater.

Figure 5:
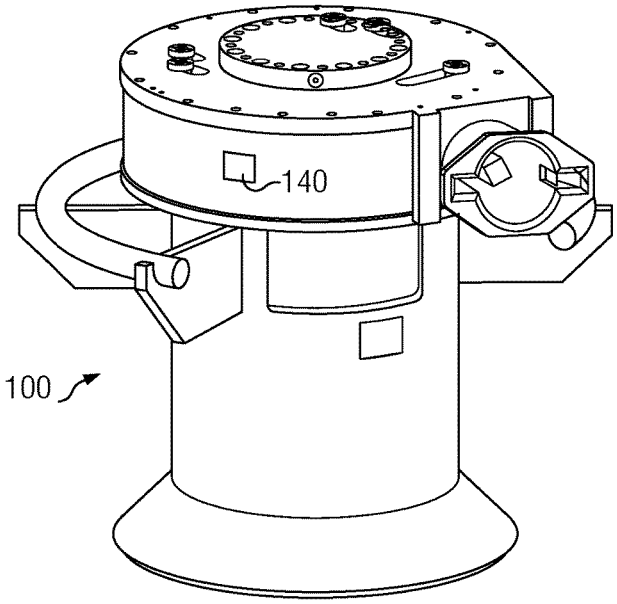
FIG. 5 depicts one example of an instrumented clamp style connector embodiment including a transmitter deployed thereon.

It will be understood that the sensors 132-135 and 172-175 may be in communication with a host structure communication system (e.g., a communication system mounted on a manifold 20 or a tree 22). For example, the sensors 132-135 and 172-175 may be in electronic communication (e.g., wireless or hardwired) with a transmitter deployed on the corresponding connector 100 and 100'. FIG. 5 depicts one example clamp-style connector embodiment including a transmitter 140 deployed thereon. In the depicted embodiment, the transmitter 140 is deployed on an outer surface of the clamp segment 120, however, it will be understood that the transmitter 140 may deployed at substantially any suitable location, for example, on an outer surface of the connector body 110, on the grab bar 118, and in or on the ROV intervention bucket 122.

The transmitter 140 may be configured to transmit sensor measurements to a communication module deployed on the host structure. For example, as depicted on FIG. 6, a wireless communication link provides electronic communication between the sensors (not shown) via the transmitter 140 and a communication system 55 on the host structure 50 such that sensor measurements may be transmitted from the respective sensor(s) to the communication system. The sensor measurements may then be further transmitted to the surface, for example, via one of the control lines 34 and the umbilical 32 (FIG. 1).

Figure 6:
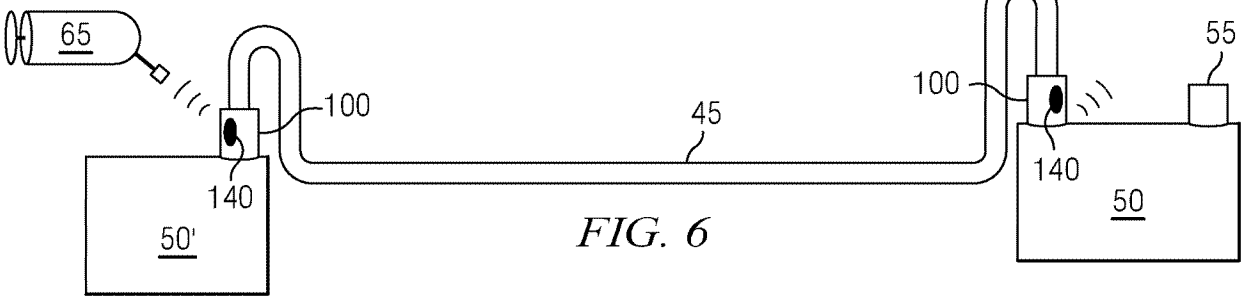
FIG. 6 depicts example wireless communication links between a transmitter deployed on the connector and a communication system or an ROV, AUV, or other mobile vehicle.

With continued reference to FIG. 6 (and subsea structure 50'), a communication link may also be provided between the sensors (not shown) via the transmitter 140 in the ROV intervention bucket 122 to a communication system deployed on the ROV 65 such that sensor measurements may be transmitted from the respective sensor(s) to the ROV 65. The sensor measurements may then be further transmitted to the surface, for example, via one of the control lines 34 and the umbilical 32 (FIG. 1). It will be understood that while FIG. 6 depicts wireless communication between the transmitter 140 and the communication system 55 and the ROV 65 that the sensors may also be connected via a hard wired electronic connection.

Figure 7:
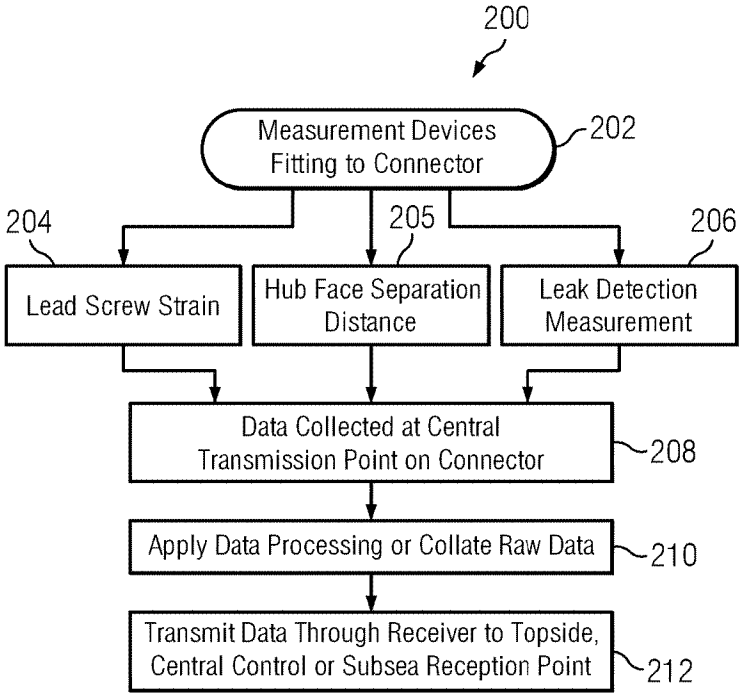
FIG. 7 depicts a flow chart of one example method embodiment.

FIG. 7 depicts a flow chart of one example method embodiment 200. At 202, one or more sensors are deployed on a subsea flowline connector (e.g., sensors 132-135 and 172-175 as depicted on FIGS. 3 and 4). As described above, the sensors may be configured, for example, to monitor lead screw strain 204, hub face separation distance 205, and/or the presence of hydrocarbons in the seawater near the connector 206. Sensor measurements may be collected at a central transmitter on the connector at 208 (e.g., during installation or during a subsea production operation). The sensor measurements may optionally be further processed or collated at 210 prior to transmission to the surface at 212 (e.g., via communication system 55 and umbilical 32). The sensor measurements may then be further processed at the surface to evaluate the state of the subsea jumper connector.

It will be understood that the above described sensor measurements may be evaluated to determine the state of the flowline jumper connector during installation and/or operation. Moreover, the transmitter 140 may be further configured with electronic memory (or in communication with an electronic memory module) such that additional information may be transmitted to the surface. The additional information may include, for example, installation instructions, prior installation history, and general information regarding the connector (e.g., including the connector type and size) and may be stored, for example, in a radio frequency identification (RFID) chip. Installation instructions may include, for example, required applied torque, locking force, and/or lead screw tension values as well as recommendations for remedial actions in the event of a failed (or failing) connector. In such embodiments, the additional information may be processed in combination with the sensor measurements to determine the state of the connector and/or to determine remedial actions.

Figure 8:
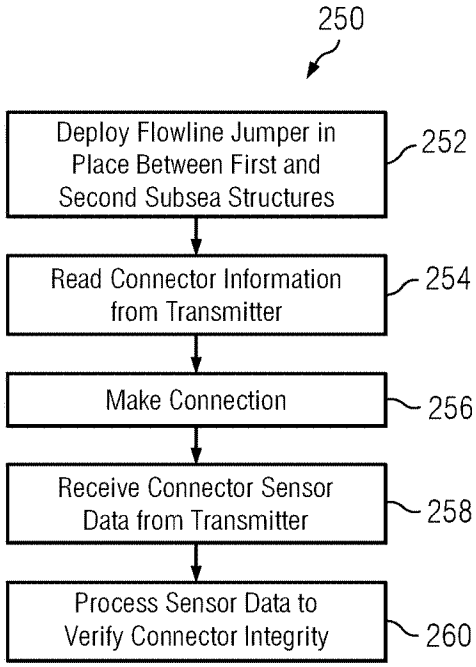
FIG. 8 depicts a flow chart of another example method embodiment.

FIG. 8 depicts a method 250 for installing and connecting a flowline jumper between first and second subsea structures. The flowline jumper is deployed in place between the subsea structures at 252. Connector information is read from a transmitter deployed on a flowline connector at 254. The information may include, for example, various specifications regarding connection to the subsea structure. A connection is established between the flowline connector and the subsea structure at 256. Sensor data is received from the transmitter at 258 and processed at 260 to verify that the connection established at 256 meets the specifications read in 254.

Figure 9:
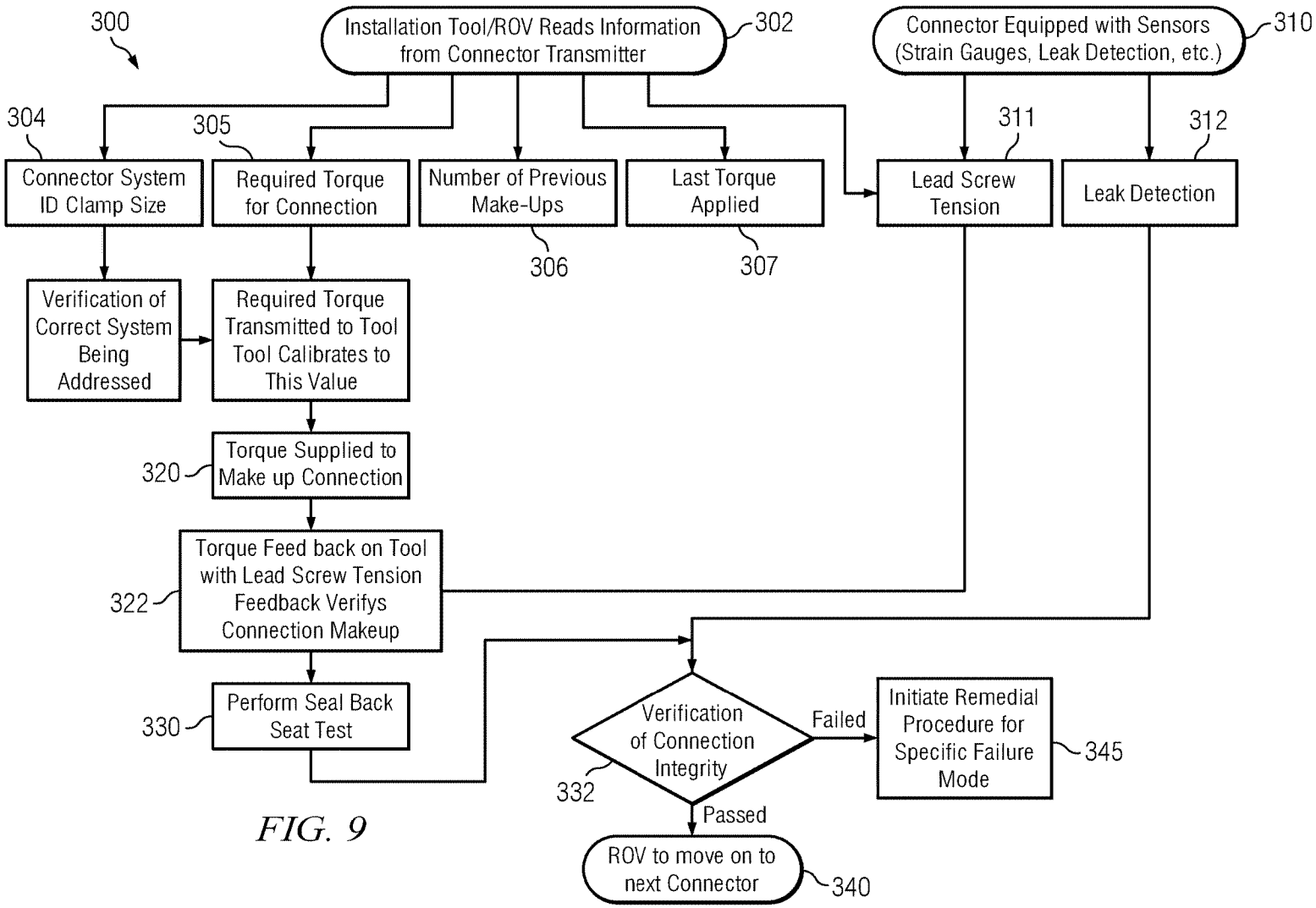
FIG. 9 depicts a flow chart of still another example method embodiment.

FIG. 9 depicts a flow chart of one example method 300 for connecting a clamp style jumper connector having at least one sensor deployed thereon. At 302, an installation tool such as an ROV reads information from a transmitter (such as an RFID chip) deployed on the connector. The information may include the connection system ID clamp size 304, the required torque for the connection 305, the number of previous make-ups 306 (the number of previous times the connector has been used), and the previous torque applied to the connector 307. The installation tool may further read sensor measurements at 310, for example including lead screw tension 311, and leak detection measurements 312. At 320, the required torque may be applied to the connector, for example, via the ROV intervention bucket 122. The lead screw tension measurements may be processed at 322 in combination with the required torque values to verify that the appropriate torque had been applied to the connector. A seal backseat test may then be initiated at 330 in combination with the leak detection sensor measurements. If no hydrocarbons (or other wellbore fluids) are measured, the integrity of the seal may be verified at 332 and the ROV may move on to make the next connection at 340. If hydrocarbons are detected during the seal backseat test at 330, remedial procedures for a particular seal failure mode may be initiated at 345. These remedial procedures may be available on the transmitter and thus may be accessed via the ROV at 302.

Figure 10:
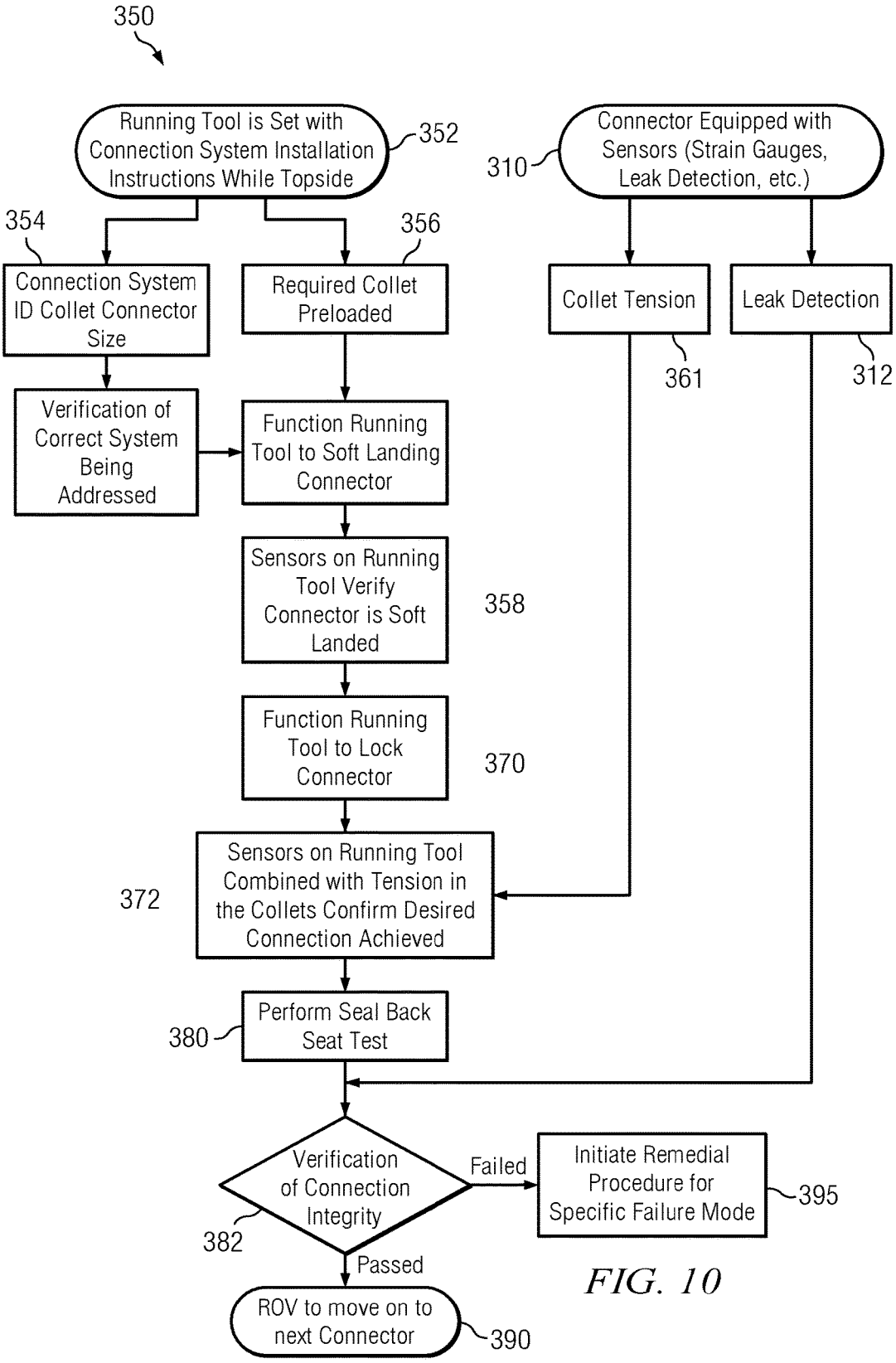
FIG. 10 depicts a flow chart of yet another example method embodiment.

FIG. 10 depicts a flow chart of one example method 350 for connecting a collet style jumper connector having at least one sensor deployed thereon. At 352 a running tool is programmed with connection system installation instructions while at the surface topside (prior to installation of the connector). The connection instructions may include, for example, a connection system ID collet connector size 354 and a required collet segment preload for installation 356. Sensors on the running tool may be used at 358 to verify that the connector has soft-landed on the subsea structure hub. The running tool may further read connector sensor measurements at 360, for example including collet segment tension 361, and leak detection measurements 362. The running tool may then be actuated to lock the connector at 370 with the sensors on the running tool being evaluated in combination with the collet segment tension measurements to determine when a desired collet segment preload (and therefore connection) has been achieved at 372. A seal backseat test may then be initiated at 380 in combination with the leak detection sensor measurements. In no hydrocarbons (or other wellbore fluids) are measured, the integrity of the seal may be verified at 382 and the ROV may move on to make the next connection at 390. If hydrocarbons are detected during the seal backseat test at 380, remedial procedures for a particular seal failure mode may be initiated at 395. These remedial procedures may be available on the transmitter and thus may be accessed via the ROV at 352.

Although an instrumented subsea flowline jumper connector and methods for deploying a flowline jumper have been described in detail, it should be understood that various changes, substitutions and alternations can be made herein without departing from the spirit and scope of the disclosure as defined by the appended claims.

The invention claimed is:

1. A subsea measurement system comprising:

a flowline jumper deployed between first and second subsea structures, the flowline jumper providing a fluid passageway between the first and second subsea structures, the flowline jumper including (i) a length of conduit and (ii) first and second connectors deployed on opposing ends of the conduit, the first and second connectors connected to corresponding hubs on the first and second subsea structures;

at least one electronic sensor deployed on at least one of the first and second connectors; and wherein: (i) the first and second connectors comprise clamp-style connectors and the at least one electronic sensor comprises a strain gauge deployed on a lead screw or (ii) the first and second connectors comprise collet-style connectors and the at least one electronic sensor comprises a strain gauge deployed on a collet segment.

2. The measurement system of claim 1, wherein the at least one electronic sensor is in electronic communication with at least one of the first subsea structure, the second, subsea structure, and a remotely operated vehicle.

3. The measurement system of claim 1, wherein the at least one electronic sensor is in electronic communication with a transmitter deployed on the connector.

4. The measurement system of claim 3, wherein the transmitter is in electronic communication with a remotely operated vehicle.

5. The flowline jumper of claim 3, wherein the transmitter is in electronic communication with a surface control system via a subsea umbilical.

6. The measurement system of claim 1, wherein the clamp-style connectors comprise:

a housing sized and shaped for deployment about a corresponding hub located on the subsea structure;

a clamp segment deployed in the housing, the clamp segment including (i) a clamping mechanism configured to open and close about the hub on the subsea structure; and wherein the lead screw engages the clamping mechanism such that rotation of the lead screw selectively opens and closes the clamping mechanism.

7. The measurement system of claim 1, wherein the collet-style connectors comprise:

a connector body;

a plurality of the collet segments circumferentially spaced and coupled to the connector body, the collet segments being sized and shaped to engage a corresponding hub located on the subsea structure, the strain gauge deployed on at least one of the collet segments.

8. The subsea measurement system of claim 1, wherein the at least one electronic sensor further comprises at least one of a load cell, a proximity sensor, and a leak sensor.

9. A method for installing a flowline jumper between first and second subsea structures, the flowline jumper including first and second connectors deployed on opposing ends thereof, the method comprising:

(a) reading information from a transmitter deployed on the first connector, the information including at least one of (i) a required torque value for the first connector and (ii) a required collet segment preload for the first connector;

(b) making a connection between the first connector and the first subsea structure;

(c) receiving sensor data from the transmitter, the transmitter being in electronic communication with at least one sensor deployed on the first connector; and (d) processing the sensor data to verify that the connection made in (b) meets (i) the required torque value or (ii) the required collet segment preload read in (a).

10. The method of claim 9, wherein the sensor data comprises strain gauge measurements.

11. The method of claim 10, wherein:

the first and second connectors comprise clamp-style connectors;

the information read in (a) comprises the required torque value; and the strain gauge measurements comprise lead screw tension measurements.

12. The method of claim 10, wherein:

the first and second connectors comprise collet-style connectors;

the information read in (a) comprises the required collet segment preload; and the strain gauge measurements comprise collet segment tension measurements.

13. The method of claim 9, further comprising:

(e) performing a seal backseat test on the first connector;

(f) evaluating leak sensor data while testing in (e) to verify connection integrity, the leak sensor data obtained using a leak sensor deployed on the first connector.

14. The method of claim 13, further comprising:

(g) initiating remedial procedures when the leak sensor data indicates the presence of hydrocarbons.

15. A clamp-style connector configured for deployment on a flowline jumper, the connector comprising:

a housing sized and shaped for deployment about a corresponding hub located on a subsea structure;

a clamp segment deployed in the housing, the clamping segment including (i) a clamping mechanism configured to open and close about the hub on the subsea structure and (ii) an outboard hub having a sealing face configured to engage a corresponding face of the hub of the subsea structure;

a lead screw engaging the clamping mechanism such that rotation of the lead screw selectively opens and closes the clamping mechanism;

at least one electronic sensor deployed on the connector; and wherein the electronic sensor comprises at least one of the following: (i) a strain gauge deployed on an external surface of the lead screw, (ii) a load cell deployed on the sealing face of the outboard hub, (iii) a proximity sensor deployed in the clamp segment and (iv) a leak sensor deployed in the clamp segment.

16. A collet style connector configured for deployment on a flowline jumper, the connector comprising:

a connector body;

a plurality of circumferentially spaced collet segments coupled to the connector body, the collet segments being sized and shaped to engage a corresponding hub located on a subsea structure;

an outboard hub deployed in the body and having a sealing face configured to engage a corresponding face of the hub of the subsea structure;

at least one electronic sensor deployed on the connector; and wherein the electronic sensor comprises at least one of the following: (i) a strain gauge deployed on an external surface of at least one of the collet segments, (ii) a load cell deployed on the sealing face of the outboard hub, (iii) a proximity sensor deployed in the body; and (iv) a leak sensor deployed in the body.

* * * * *